US008887971B2

(12) United States Patent
Hou

(10) Patent No.: US 8,887,971 B2
(45) Date of Patent: Nov. 18, 2014

(54) KNIFE SHEATH WITH METAL RETAINING STRAP

(71) Applicant: Dennis T. C. Hou, Hong Kong (CN)

(72) Inventor: Dennis T. C. Hou, Hong Kong (CN)

(73) Assignee: Dennis Company Limited, Tsuen Wan, N.T. (HK)

( * ) Notice: Subject to any disclaimer, the term of this patent is extended or adjusted under 35 U.S.C. 154(b) by 0 days.

(21) Appl. No.: 13/832,345

(22) Filed: Mar. 15, 2013

(65) Prior Publication Data

US 2014/0263522 A1 Sep. 18, 2014

(51) Int. Cl.

| | |
|---|---|
| ***B26B 29/02*** | (2006.01) |
| ***B26B 3/06*** | (2006.01) |
| ***A45F 5/14*** | (2006.01) |
| ***A45F 5/02*** | (2006.01) |

(52) U.S. Cl.
CPC .. *A45F 5/14* (2013.01); *A45F 5/021* (2013.01)
USPC ..... 224/232; 30/151

(58) Field of Classification Search
CPC ..... A45F 5/14; A45F 5/021; B26B 29/02
USPC ..... 224/232; 30/151; 206/349
See application file for complete search history.

(56) References Cited

U.S. PATENT DOCUMENTS

| | | | | | |
|---|---|---|---|---|---|
| 2,387,900 | A | * | 10/1945 | Hartwell | 224/197 |
| 2,410,640 | A | * | 11/1946 | Engle | 224/198 |
| 2,528,501 | A | * | 11/1950 | Davis | 224/232 |
| 2,650,008 | A | * | 8/1953 | Morseth | 224/232 |
| 2,687,833 | A | * | 8/1954 | Sutton | 224/232 |
| 2,783,536 | A | * | 3/1957 | McQueary | 30/151 |
| 2,859,516 | A | * | 11/1958 | McQueary | 30/151 |
| 3,246,813 | A | * | 4/1966 | Miller | 224/232 |
| 3,257,050 | A | * | 6/1966 | Smith | 224/232 |
| 3,307,756 | A | * | 3/1967 | Erkers et al. | 224/232 |
| 3,524,570 | A | * | 8/1970 | Seguine | 224/232 |
| 3,533,540 | A | * | 10/1970 | Carinci | 224/232 |
| 3,958,330 | A | * | 5/1976 | Hutchens | 30/151 |
| 3,977,582 | A | * | 8/1976 | McMahon | 224/246 |
| 4,052,218 | A | * | 10/1977 | Samat et al. | 430/345 |
| D251,436 | S | * | 3/1979 | Johnson | D3/220 |
| 4,320,569 | A | * | 3/1982 | Todd, Sr. | 29/469.5 |
| 4,414,744 | A | * | 11/1983 | Collins | 30/151 |
| 4,524,892 | A | * | 6/1985 | Ozeki | 224/256 |
| 4,558,516 | A | * | 12/1985 | Collins | 30/151 |

(Continued)

FOREIGN PATENT DOCUMENTS

| | | | | | |
|---|---|---|---|---|---|
| DE | 4217637 | A1 | * | 12/1992 | A45F 5/14 |
| JP | 07213762 | A | * | 8/1995 | B26B 29/02 |

*Primary Examiner* — Justin Larson
*Assistant Examiner* — Lester L Vanterpool
(74) *Attorney, Agent, or Firm* — Husch Blackwell LLP

(57) ABSTRACT

A sheath having an elongated lower portion having first and second sides joined along opposing edges to form a pocket, a middle portion and a top portion comprising only the first side, an elongated resilient metal strap joined on a first end to the middle portion of the first side and a resilient snap connector, with a first portion of the resilient snap connector located proximate a second end of the resilient metal strap, the first portion releasably connects to a second portion of the resilient snap connector located on the middle portion of the second side thereby preventing removal from the knife from the pocket and wherein the elongated resilient metal strap becomes relatively straight, parallel to the first and second sides when the first and second portions are released from one another.

5 Claims, 1 Drawing Sheet

(56) References Cited

U.S. PATENT DOCUMENTS

| | | | | | |
|---|---|---|---|---|---|
| 4,726,498 | A * | 2/1988 | Esposito | 224/232 |
| 4,759,483 | A * | 7/1988 | Willoughby | 224/672 |
| 4,886,197 | A * | 12/1989 | Bowles et al. | 224/243 |
| 4,942,663 | A * | 7/1990 | Ray, Sr. | 30/151 |
| 5,146,684 | A * | 9/1992 | Hagler | 30/162 |
| 5,155,911 | A * | 10/1992 | Collins | 30/162 |
| D367,513 | S * | 2/1996 | Blumberg | D22/118 |
| 5,568,889 | A * | 10/1996 | Holloway et al. | 224/661 |
| 5,794,347 | A * | 8/1998 | Serpa | 30/162 |
| 5,984,046 | A * | 11/1999 | Urso, Jr. | 182/129 |
| 6,202,908 | B1 * | 3/2001 | Groover | 224/239 |
| 6,840,416 | B2 * | 1/2005 | Aberman | 224/232 |
| 7,025,238 | B2 | 4/2006 | Hughes et al. | |
| 7,434,316 | B2 * | 10/2008 | Nenadic | 30/143 |
| 7,587,827 | B2 * | 9/2009 | Scheiter | 30/151 |
| 2003/0006257 | A1 * | 1/2003 | Aberman | 224/232 |
| 2003/0066855 | A1 * | 4/2003 | Stone | 224/673 |
| 2007/0266569 | A1 * | 11/2007 | Nenadic | 30/151 |
| 2008/0250652 | A1 * | 10/2008 | Fellhoelter | 30/164 |
| 2013/0026054 | A1 * | 1/2013 | Adams | 206/349 |

* cited by examiner

KNIFE SHEATH WITH METAL RETAINING STRAP

FIELD

The field relates to knives and more particularly to sheaths for carrying knives on the belt of a user.

BACKGROUND

Sheaths for carrying knives are generally known. Such sheaths are typically constructed by providing two elongated layers of material with one layer longer than another and connecting the layers along opposing longitudinal edges. The top end of the longer of the two layers may be folded over to form a belt loop.

The traditional material used for making sheaths is predominately leather because of its durability and resistance to knife cuts. More recent advances include the user of woven materials such as canvas.

One of the difficulties of making a durable sheath is the method of joining the opposing edges of the elongated layers of material used for making the sheath. Past methods have included riveting or even sewing. However, rivets can dull the sharp edge of the knife while sheaths that are sewn can be easily damaged by the sharp edge of the knife cutting the sewn edge upon removal of the knife.

Another difficulty is that a knife can be easily and inadvertently dislodged from the sheath resulting in loss of the knife. One solution has been to provide a strap that folds across the handle of the knife, thereby preventing inadvertent loss of the knife. However, where a user attempts to remove or insert the knife without releasing the strap, the strap can be damaged. Accordingly, a need exists for better ways of preventing the inadvertent loss of knives from carrying sheaths.

DETAILED DESCRIPTION OF AN ILLUSTRATED EMBODIMENT

Figure 1A:
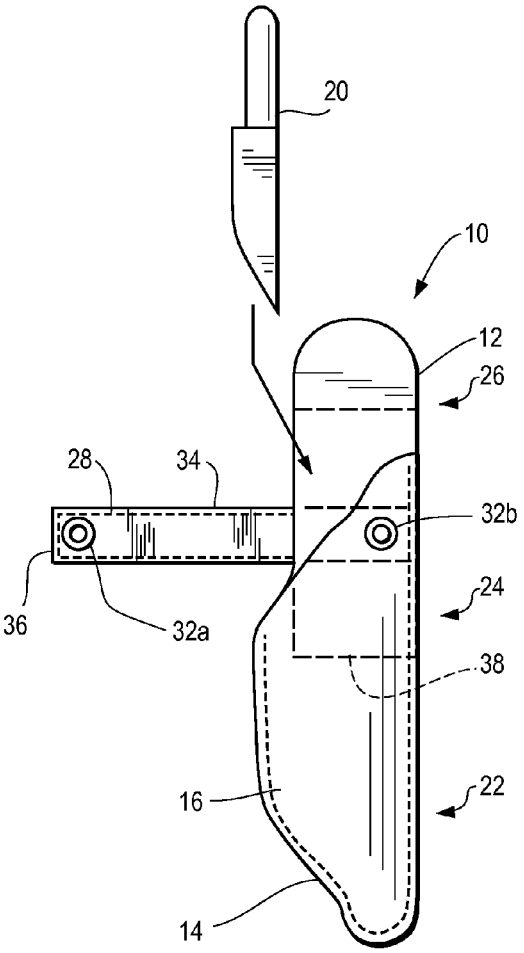
FIGS. 1*a-c* depict side, front and top views of a sheath for a knife in accordance with an illustrated embodiment.
Figure 1B:
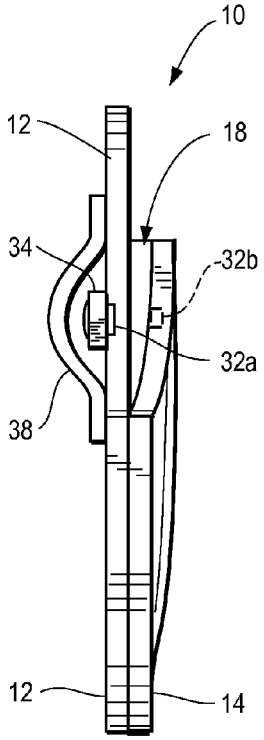
Figure 1C:
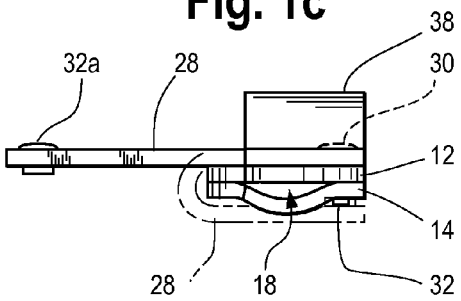

FIGS. 1*a-c* show a side, a front and a top view of a sheath 10 shown generally in accordance with an illustrated embodiment. As shown in FIGS. 1*a-c*, the sheath may be constructed from relatively thin layers of material (e.g., leather, canvas, etc.) cut into strips. In this regard, the sheath may include a first elongated strip of material 12 and a second elongated strip 14 of material, where the first strip is longer than the second strip. The strips may be joined along portions of opposing longitudinal marginal edges using an appropriate attachment structure or edge joinery 16. The attachment structure may include rivets, thread, glue, metal clips or any other appropriate attachment technology.

The sheath may include a top portion 26, a middle portion 24 and a lower portion 22. The first and second strips of the lower portion is joined along opposing sides by the attachment structure to form a pocket 18. The pocket is of an appropriate length, width and thickness to receive the blade of a knife.

The first and second strips of the middle portion are joined only along one edge. It should also be noted that the width of the second strip tapers from being as wide as the first strip at the bottom to a point at the top. This allows the knife to be rotated as it is removed from the pocket.

The top portion consists solely of the first strip. The middle and top portions are substantially equal to a length of the handle of the knife.

Attached to an outside surface of the first strip is a belt loop 38. The belt loop extends parallel to the longitudinal axis of the first strip and connects on a first end to point near the intersection of the lower and middle portions and on a second end to the top portion.

Also attached to an outside surface of the first strip of material is an elongated, resilient cut-resistant strap 28. Under one illustrated embodiment, the strap is made of metal. The strap is attached to the outside surface of the middle portion of the first strip via a connector (e.g., a rivet). A snap connector 32 on the second, opposing end of the strap is used to secure the second end of the strap to the opposing outside surface of the second strip (as shown in phantom in FIG. 1*c*).

The snap connector 32 includes a first portion 32*a* permanently attached to the second end of the strap and a second portion 32*b* permanently attached to the outside surface of the middle portion of the second strip.

When the first and second portions of the connector are snapped together, the strap is folded around and closes off the open side of the middle portion as shown by the phantom lines in FIG. 1*c*, thereby preventing the knife from being removed or accidentally dislodged from the pocket.

The strap may be made of a relatively thin strip of a resilient material (e.g., spring steel) that assumes a straight shape when the snap connector is released. Alternatively, the strap may be constructed of a polymer, polymeric or other cut-resistant material similar to, for example, spring steel.

The strap may be covered by a layer of a woven material 34 to cover any sharp edges and to make the snap connector of the strap easier to connect and disconnect. For example, the woven material that covers the strap may extend past the distal, second end of the strap to form a flexible tab 36. The flexibility of the tab 36 allows a user to more easily grasp the tab between thumb and forefinger and pull on the tab in order to dislodge the first portion of the snap connector from the second portion.

The sheath of FIG. 1 solves the problem of cutting of the strap during insertion and removal of the knife from the pocket. Cutting is avoided via two different mechanisms. First, the resilient metal strap springs out of the way the instant that the snap connector is released. Second, the metallic nature of the strap resists the possibility of the damage to the strap in the event that a user attempts to insert the knife into the pocket while strap blocks the entrance to the pocket. Materials other than metal, such as polymer or other material having similar resiliency and spring-like properties and resistance to cutting also could be used. The woven covering on the strap, in turn, protects the blade should the edge make contact with the strap.

In general, the sheath includes a sheath, the sheath having an elongated lower portion having first and second sides joined along opposing edges to form a pocket that receives the blade of a knife, a middle portion where the first and second sides are joined along only one edge and a top portion comprising only the first side, the second side terminates at the junction of the middle and top portions, an elongated resilient metal strap joined on a first end to the middle portion of the first side and a resilient snap connector, with a first portion of the resilient snap connector located proximate a second end of the resilient metal strap, the first portion releasably connects to a second portion of the resilient snap connector located on the middle portion of the second side thereby preventing removal from the knife from the pocket and wherein the elongated resilient metal strap becomes relatively straight, parallel to the first and second sides when the first and second portions are released from one another thereby allowing removal of the knife without contact with the elongated resilient metal strap.

A specific embodiment of method and apparatus for distributing calls has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. An apparatus comprising:

a sheath, the sheath having an elongated lower portion having first and second sides joined along opposing edges to form a pocket that receives the blade of a knife, a middle portion where the first and second sides are joined along only one edge and a top portion comprising only the first side, the second side terminates at the junction of the middle and top portions;

an elongated resilient cut-resistant metal strap joined on a first end to the middle portion of the first side;

a woven material that covers the metal strap and that protects the blade, the woven material covering the metal strap inside the woven material from end-to-end;

a flexible tab of the woven material wherein the woven material extends past a distal portion of the second end to form the flexible tab; and a resilient snap connector, with a first portion of the resilient snap connector located proximate and extending through a second end of the resilient metal strap and woven covering, the first portion releaseably connects to a second portion of the resilient snap connector located on the middle portion of the second side thereby preventing removal from the knife from the pocket wherein the woven material covers any sharp edges of the metal strap making the resilient snap connector easier to connect and disconnect, where the flexible tab allows a user to more easily grasp the tab between thumb and forefinger and pull on the tab in order to dislodge the first portion of the snap connector from the second portion and wherein the elongated resilient metal strap becomes relatively straight, parallel to the first and second sides when the first and second portions are released from one another thereby allowing removal of the knife without contact with the elongated resilient metal strap.

2. The apparatus as in claim 1 further comprising a belt loop connected on opposing ends to the lower and top portions of the first side of the sheath.

3. An apparatus comprising:

a sheath, the sheath having first and second sides joined along opposing edges of a lower portion to form a pocket, the first and second sides extending upwards from the lower portion and joined along only one side to form a middle portion and the first side extending upwards from the middle portion to form top portion;

a belt loop extending parallel to the first and second sides and joined on opposing ends to the middle and top portions;

an elongated resilient metal strap joined on a first end to the middle portion of the first side;

a woven material that covers the metal strap and that protects the blade, the woven material covering the metal strap inside the woven material from end-to-end;

a flexible tab of the woven material wherein the woven material extends past a distal portion of the second end to form the flexible tab; and a resilient snap connector, with a first portion of the resilient snap connector located proximate and extending through a second end of the resilient metal strap and woven material, the first portion releaseably connects to a second portion of the resilient snap connector located on the middle portion of the second side thereby preventing removal from the knife from the pocket wherein the woven material covers any sharp edges of the metal strap making the resilient snap connector easier to connect and disconnect, where the flexible tab allows a user to more easily grasp the tab between thumb and forefinger and pull on the tab in order to dislodge the first portion of the snap connector from the second portion and wherein the elongated resilient metal strap becomes relatively straight, parallel to the first and second sides when the first and second portions are released from one another thereby allowing removal of the knife without contact with the elongated resilient metal strap.

4. The apparatus as in claim 3 wherein the woven material further comprises an extension that extends away from the resilient metal strap and resilient snap connector past the second end thereby allowing a user to grasp the extension and pull the resilient snap connector apart.

5. The apparatus as in claim 3 further comprising a belt loop connected on opposing ends to the lower and top portions of the first side of the sheath.

* * * * *